US007438625B2

(12) United States Patent
Tremblay et al.

(10) Patent No.: US 7,438,625 B2
(45) Date of Patent: Oct. 21, 2008

(54) CENTRAL GORE WITH CROSSED PIECES AND POWERNET CONSTRUCTION

(75) Inventors: Louise Tremblay, Montréal (CA); Ella Rusinowicz, Montréal (CA); Raymonde Tranchemontagne, Montréal (CA)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 217 days.

(21) Appl. No.: 10/900,976

(22) Filed: Jul. 28, 2004

(65) Prior Publication Data

US 2006/0025044 A1 Feb. 2, 2006

(51) Int. Cl.
*A41C 3/00* (2006.01)

(52) U.S. Cl. ..... 450/60; 450/62; 450/67

(58) Field of Classification Search ..... 450/51, 450/60, 62, 64, 65, 67, 71–73, 79, 85, 87, 450/41, 45–47; 2/255, 256, 258–260
See application file for complete search history.

(56) References Cited

U.S. PATENT DOCUMENTS

| | | | | | |
|---|---|---|---|---|---|
| 1,923,821 | A | * | 8/1933 | Gudeman | 450/85 |
| 1,936,532 | A | | 11/1933 | Weil | |
| 1,966,174 | A | * | 7/1934 | Jones | 450/58 |
| 2,022,317 | A | * | 11/1935 | Kemp | 450/85 |
| D98,090 | S | | 1/1936 | Rosenthal | |
| 2,131,213 | A | | 9/1938 | Becker et al. | |
| 2,471,670 | A | * | 5/1949 | Becker et al. | 450/5 |
| 2,508,580 | A | * | 5/1950 | Mixon | 450/41 |
| 2,541,147 | A | | 2/1951 | Becker | |
| 2,585,137 | A | | 2/1952 | Kurland | |
| 2,621,329 | A | | 12/1952 | Kaufman | |
| 2,679,646 | A | * | 6/1954 | Cousins | 450/39 |
| 2,736,898 | A | | 3/1956 | Lax et al. | |
| 2,753,563 | A | * | 7/1956 | Blitch | 450/62 |
| 2,755,479 | A | | 7/1956 | Cascio | |
| 2,843,130 | A | | 7/1958 | Block et al. | |
| 2,866,462 | A | | 12/1958 | Faron | |
| 2,867,216 | A | | 1/1959 | Champagne et al. | |
| 2,882,906 | A | * | 4/1959 | Steinmetz | 450/59 |
| 2,897,822 | A | | 8/1959 | Sillery | |
| 2,923,301 | A | | 2/1960 | Di Tullio | |
| 3,024,789 | A | | 3/1962 | Sillery | |
| 3,056,411 | A | | 10/1962 | Child | |
| D194,745 | S | | 3/1963 | Cole | |
| D199,437 | S | | 10/1964 | Cole | |
| D199,438 | S | | 10/1964 | Cole | |
| 3,163,167 | A | | 12/1964 | Chisholm | |

(Continued)

*Primary Examiner*—Gloria Hale
(74) *Attorney, Agent, or Firm*—Womble Carlyle Sandridge & Rice, PLLC

(57) ABSTRACT

A brassiere having a body portion having a first breast cup with a lower edge and a second breast cup with a lower edge is provided. A first elastic crosspiece adjacent the lower edge of the first breast cup and a second elastic crosspiece adjacent the lower edge of the second breast cup is provided. The first crosspiece and the second crosspiece overlap at a portion to form a connection between the cups. A brassiere having a body portion having a first breast cup with a lower edge and a second breast cup with a lower edge, a first elastic crosspiece connected to the lower edges of the first and second breast cups, and a second elastic crosspiece connected to the lower edges of the first and second breast cups is provided. The first and second crosspieces overlap to form a diamond-shaped region beneath the cups

19 Claims, 3 Drawing Sheets

U.S. PATENT DOCUMENTS 3,202,153 A * 8/1965 Sachs et al. ..... 450/59
D204,264 S * 4/1966 Hayes ..... D2/709
3,256,886 A * 6/1966 Sachs ..... 450/59
3,304,940 A 2/1967 Holscher
3,322,127 A * 5/1967 Sachs ..... 450/59
D209,269 S 11/1967 Tuschman
D210,761 S 4/1968 Tuschman
3,381,689 A 5/1968 Sachs
3,393,681 A 7/1968 Sachs
3,464,417 A 9/1969 Zucker
3,478,747 A 11/1969 Sachs
3,545,445 A * 12/1970 Vale et al. ..... 450/59
3,595,243 A 7/1971 Mount
3,746,008 A 7/1973 LoCascio et al.
4,127,135 A 11/1978 Stern
4,655,224 A * 4/1987 Stern et al. ..... 450/36
4,781,651 A 11/1988 Ekins
5,167,566 A 12/1992 Novitsky et al.
5,171,182 A 12/1992 Heinen
5,660,577 A 8/1997 Modena
5,904,607 A 5/1999 Abadi
6,306,005 B1 * 10/2001 Archer ..... 450/47
6,439,959 B1 8/2002 Magrone et al.
6,514,120 B1 2/2003 Hass
6,551,171 B1 4/2003 Hass et al.
6,572,437 B1 6/2003 Waitz
6,685,534 B2 2/2004 Mitchell et al.

* cited by examiner

CENTRAL GORE WITH CROSSED PIECES AND POWERNET CONSTRUCTION

BACKGROUND OF THE INVENTION

1. Field of the Invention

The present invention relates to brassieres having breast cups with a support and comfortable fit. More particularly, the present invention relates to brassieres having breast cups each having a mesh underbust member for providing support and comfortable fit. Still more particularly, the present invention relates to brassieres having breast cups each with an elastic underbust member that crosses beneath each breast cup to the other breast cup to provide improved comfort and support for enhanced fit.

2. Description of Related Art

A wide range of brassiere styles are currently available in the women's undergarment market. These different styles that are offered in many different sizes in an attempt to satisfy the needs of all women. For brassieres to truly satisfy the women, they must not only be available in a broad range of sizes, but they must also provide the necessary support and comfort, as well as an acceptable fit to the wearer.

While improvements have been made, current brassieres still lack the adaptability to properly fit many women during their daily activities. Often, women buy several brassieres that seem to fit properly in the store, only to realize that the brassiere is not comfortable when worn throughout the day. The brassiere may not be comfortable because the fit is not proper for the woman's particular figure. Alternatively, a brassiere may not be comfortable because it does not allow for active movement. Still further, the brassiere may provide for active movement but may not provide for proper support during active movement.

Accordingly, there is a need for a brassiere that provides necessary support and comfort while offering a customized fit during active movement throughout the day.

SUMMARY OF THE INVENTION

It is an object of the present invention to provide a brassiere that has a member beneath each breast cup to provide an optimal fit to the wearer's breasts during a variety of movements.

It is another object of the present invention to provide a brassiere having an elasticized member beneath each breast cup for supporting the breasts of the wearer at all times during use of the brassiere.

It is still another object of the present invention to provide such a brassiere having a pair of angled members, each for a different one of the pair of breast cups, to conform to the shape of the chest wall.

It is still another object of the present invention to provide such a brassiere having an elasticized mesh beneath each breast cup and around the back of the brassiere to provide an optimal fit around the torso of the wearer.

It is a further object of the present invention to provide such a brassiere in which the pair of angled mesh support members overlap beneath the center of the breast cups to provide a region of stability.

These and other objects and advantages of the present invention are achieved by the present invention that provides a brassiere for supporting wearer's breasts for a comfortable and optimal fit. The brassiere has a body portion that includes a pair of breast cups, side panels and elasticized underbust members that are connected to the body portion. Preferably, the elasticized underbust members are a pair of two-ply powernet pieces of fabric that are each connected beneath one of the pair of breast cups and cross to connect to the other of the pair of breast cups to create a multi-ply stabilizing region beneath the center of the breast cups.

DETAILED DESCRIPTION OF THE INVENTION

Figure 1:
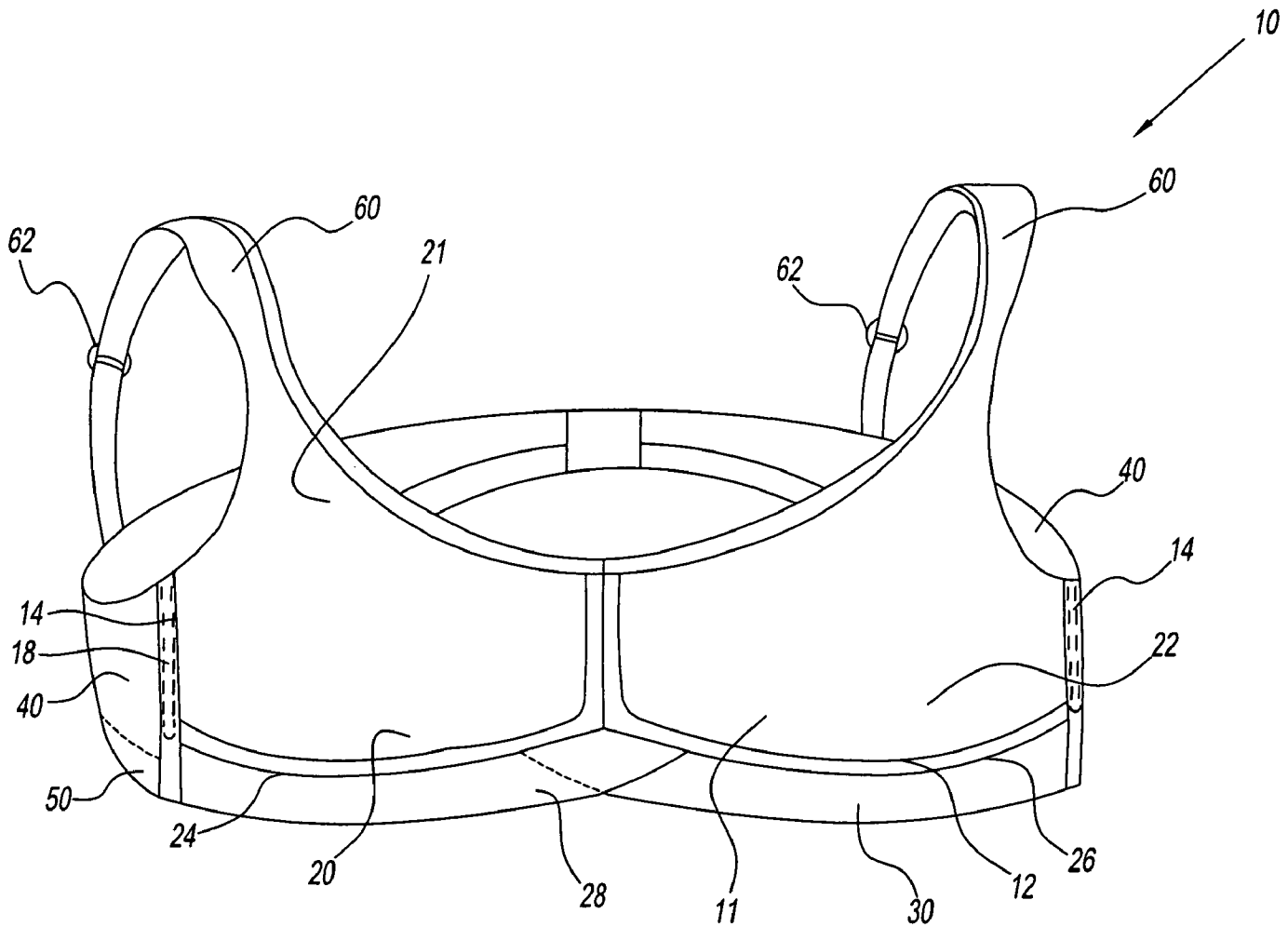
FIG. 1 is a front perspective view of a first embodiment of a brassiere according to the present invention.

Referring to the figures, and more particularly to FIG. 1, a brassiere according to the present invention is generally designated by reference numeral 10. The brassiere 10, in its conventional aspects, has a body 11 with a pair of breast cups 20 and 22, a pair of side panels 40 each adjacent and connected to a different one of the breast cups, and preferably a back band 50 along the back base or lower back edge of brassiere 10. Each breast cup 20, 22 can be either a single- or a double-ply cup. Preferably, each breast cup 20, 22 is a double-ply cup. Each breast cup 20, 22 has an outer layer 21 and an inner layer 23. Outer layer 21 can have a decorative pattern such as a lace jacquard of 85% to approximately 15% spandex. Inner layer 23 can have a knitted tricot of approximately 92% polyester and 8% spandex. Each layer is made of a low elasticity material. Alternatively, each breast cup 20,22 could have a single layer of material.

Figure 2:
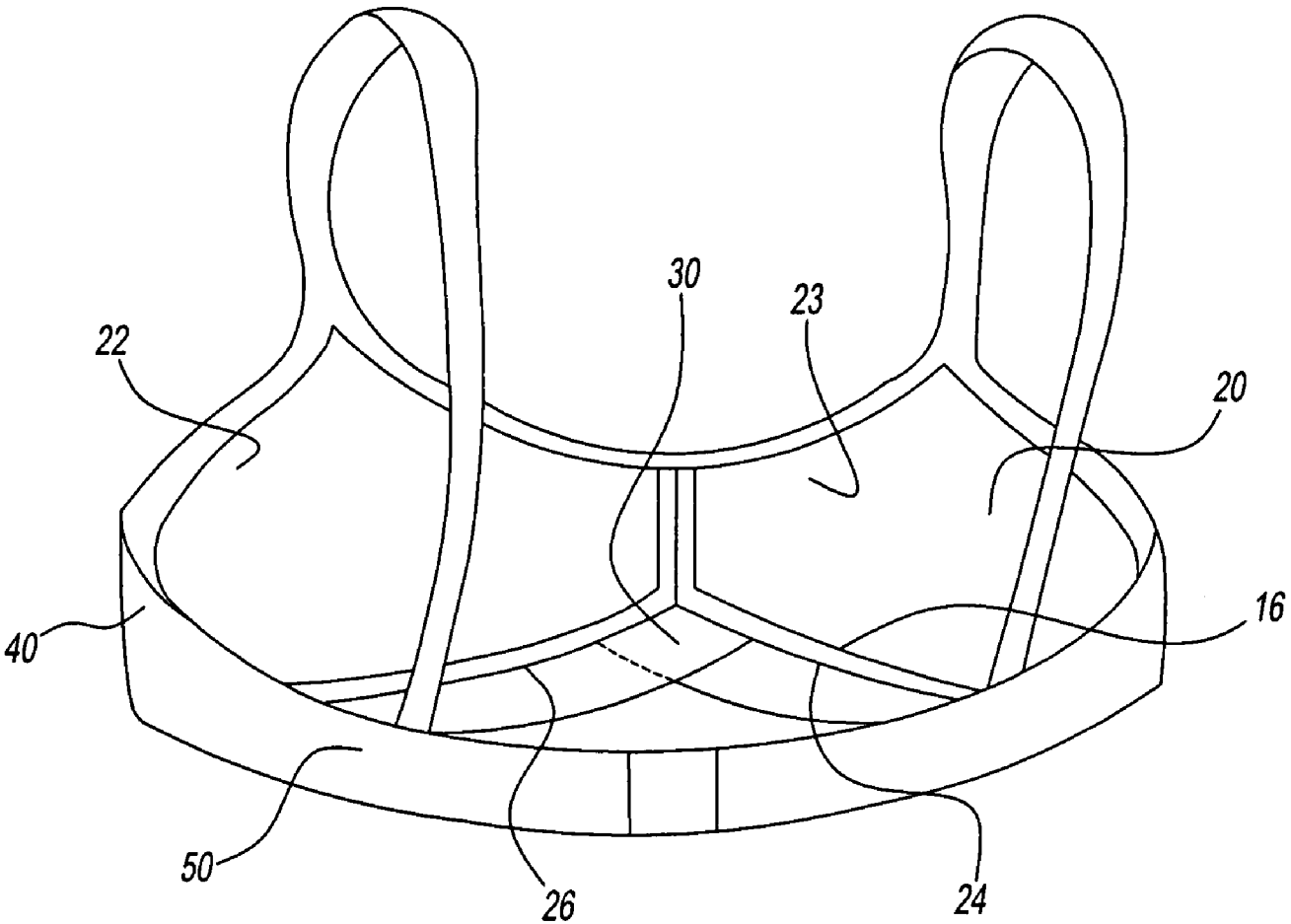
FIG. 2 is a rear perspective view of the brassiere of FIG. 1.
Figure 3:
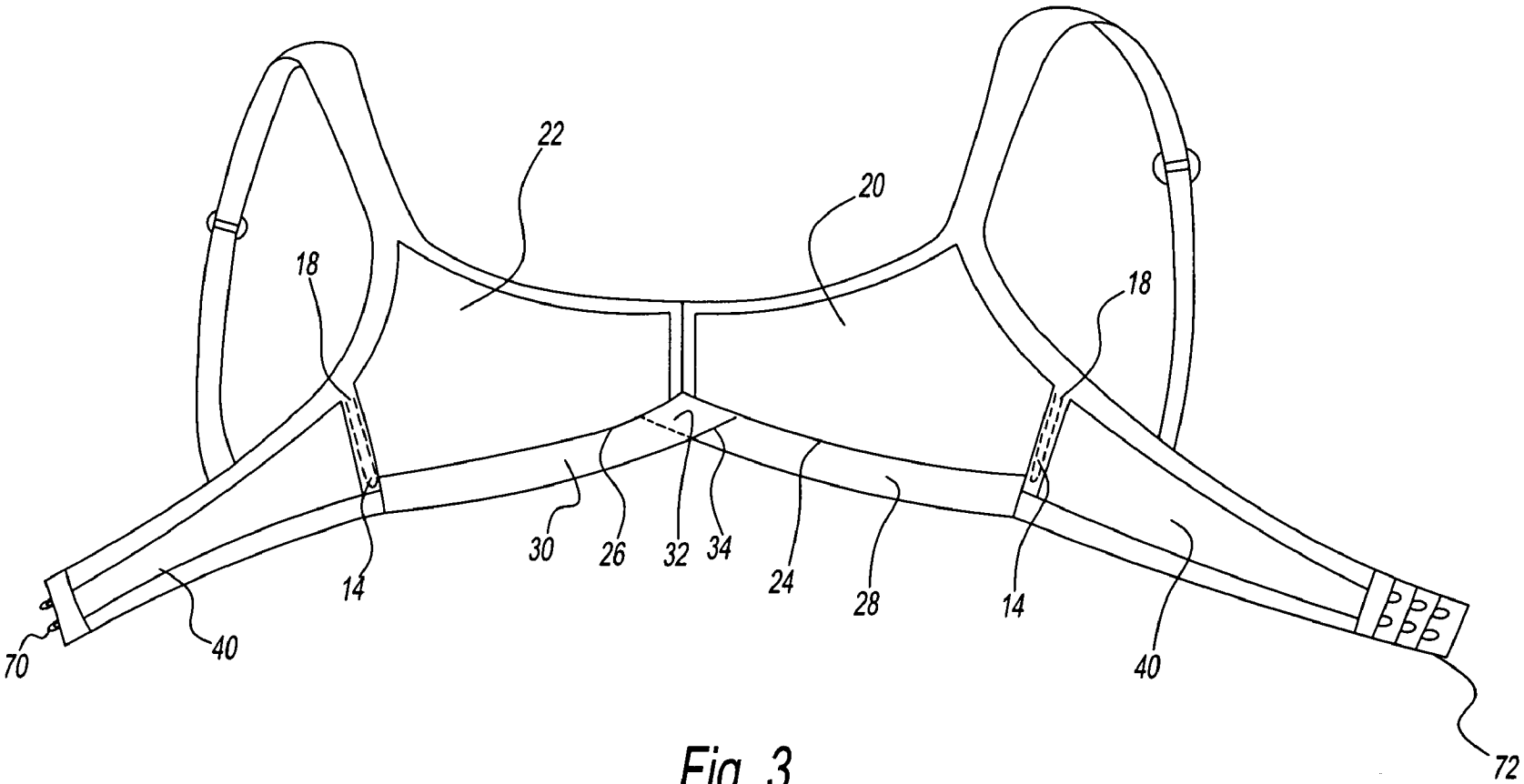
FIG. 3 is a rear plan view of the brassiere of FIG. 1.

Referring to FIGS. 1 through 3, body 11 has a lower trim or edge 12 that is along the lower edge of the breast cups 20, 22. Brassiere 10 preferably has a pair of shoulder straps 60, each associated with a different one of the breast cups 20, 22 and pair of side panels 40. Each shoulder strap 60 preferably has a conventional length adjusting means or device 62. The side panels 40 are removably connected together along their free or distal ends by a conventional fastener, preferably in the form of a conventional hook 70 and eye 72 arrangement as shown in FIG. 3.

Breast cup 20 has an arcuate lower edge 24 that curves in an upward direction towards the center of brassiere 10. Similarly, breast cup 22 has an arcuate lower edge 26 that curves in an upward direction towards the center of brassiere 10 so that lower edges 24, 26 meet and form an inverted V-shape at the area beneath and between the breast cups. Each of the breast cups 20 and 22 has an elastic crosspiece 28 and 30, respectively, directly connected thereto. Preferably, each crosspiece 28, 30 can be folded over to have two plies. Alternatively, each crosspiece 28, 30 can have a single ply with a finished lower edge.

Crosspieces 28 and 30 are angled upward toward the area beneath the breast cups 20, 22 to follow the upward curve of the respective lower edges 24, 26 of their respective breast cups 20 and 22. Crosspiece piece 28 is positioned adjacent to breast cup 20, breast cup 22, a side panel 40, and back band 50. Similarly, crosspiece 30 is positioned adjacent breast cup 22, breast cup 20, a side panel 40, and back band 50. Each side panel 40 has a lateral channel 14 adjacent to one of the pair of breast cups 20 and 22. Preferably, each side panel 40 is formed of the same material as the crosspieces 28, 30.

Each crosspiece 28 and 30 is preferably made of an elastic material that contains approximately 83% nylon and 17% spandex. Each crosspiece 28, 30 is preferably a folded mesh material whose edges are contained between the trim or edge 12 at the front of the breast cups and a lower trim 16 on the inner side of the breast cups to prevent separation of the edges. Each crosspiece 28, 30 has greater elasticity in the horizontal direction around the torso than in the vertical direction. The thin and angled profile of the crosspieces 28, 30 coupled with their elasticity enables them to lie flat against the chest wall to provide a conforming fit to the wearer, even if the breast cups 20, 22 do not fit the wearer perfectly. By lying flat against the chest wall, crosspieces 28, 30 will not leave an indentation that often results after wearing a brassiere having a straight torso-encircling band at the front of the brassiere.

As shown in FIG. 3, each crosspiece 28 and 30 is connected to a lateral channel 14 of a side panel 40. Each side channel 14 contains an insert 18, and has a vertical extent equal to the vertical extent of the respective breast cup 20, 22. Insert 18 is preferably made of a semi-rigid plastic material, such as acetal resin, or any such material that will function properly after being exposed to repeated washings. Side panels 40, back band 50 and the flexible crosspieces 28 and 30 are directly connected to each other and allow for complete flexibility around the entire torso without being hindered by a side insert. The complete flexibility ensures that brassiere 10 will be comfortable to wear for long periods of time during a variety of activities. Insert 18 ensures that there will not be any chaffing or digging by an insert into the flesh immediately beneath the breast tissue or into the chest wall because it does not extend between back band 50 and crosspieces 28, 30.

An overlap region or central gore 32 is formed at the intersection of crosspieces 28 and 30. Central gore 32 lies directly beneath the center of the breast cups 20, 22 and directly beneath the center of the wearer's breasts. This region has a sewn lower edge 34 to maintain a diamond-shaped area during movement. Central gore 32 has a lower degree of elasticity during movement than crosspieces 28 and 30 because of sewn edge 34; therefore, it provides a high degree of stability at the center of the brassiere. Additionally, central gore 32 will prevent brassiere 10 from shifting during movement.

While the present invention has been described with reference to one or more exemplary embodiments, it will be understood that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that the invention will include all embodiments falling within the scope of the appended claims.

We claim:

1. A brassiere comprising:

a body having a first breast cup with a lower edge and a second breast cup with a lower edge, and a center therebetween;

the lower edges of the first breast cup and the second breast cup each curving upwardly toward the center of the brassiere;

a first elastic crosspiece adjacent the lower edge of said first breast cup and a second elastic crosspiece adjacent the lower edge of said second breast cup, the first and second elastic crosspieces having a first elasticity and terminating at the center of the brassiere to form a lower peripheral edge of the brassiere; and the first crosspiece and the second crosspiece overlapping and connecting to form a central gore between said first and second breast cups, the central gore having a second elasticity lower than the first elasticity of the first and second elastic crosspieces.

2. The brassiere according to claim 1, wherein said lower edges form an approximate inverted V-shape.

3. The brassiere according to claim 2, wherein said first crosspiece and said second crosspiece are each folded over to have two plies of material.

4. The brassiere according to claim 1, wherein said overlap has a diamond shape.

5. The brassiere according to claim 1, wherein said first crosspiece and said second crosspiece each has a single ply of material.

6. The brassiere according to claim 1, wherein said first crosspiece and said second crosspiece comprises a mesh fabric.

7. The brassiere according to claim 6, wherein said mesh fabric is approximately 83% nylon and approximately 17% spandex.

8. The brassiere according to claim 1, wherein said first elastic crosspiece and said second elastic crosspiece are each made from a fabric having approximately 83% nylon and approximately 17% spandex.

9. A brassiere comprising:

a body having a first breast cup with a lower edge and a second breast cup with a lower edge, and a center therebetween;

the lower edges of the first breast cup and the second breast cup each curving upwardly toward the center of the brassiere;

said first breast cup and said second breast cup each having a lateral border having a channel, each channel having an insert therein;

a first elastic crosspiece connected to the lower edge of the first breast cup, and a second elastic crosspiece connected to the lower edge of said second breast cup, the first and second elastic crosspieces having a first elasticity and terminating at the center of the brassiere to form a lower peripheral edge of the brassiere;

the first and the second crosspieces overlapping to form a diamond-shaped region between said first breast cup and said second breast cup, the diamond-shaped region having a second elasticity lower than the first elasticity of the first and second elastic crosspieces.

10. The brassiere according to claim 9, wherein said lower edges form an approximate inverted V-shape.

11. The brassiere according to claim 9, wherein said first crosspiece and said second crosspiece are each folded over to have two plies of material.

12. The brassiere according to claim 9, wherein said diamond-shaped region formed by said first crosspiece and said second crosspiece is a central gore.

13. The brassiere according to claim 9, wherein said first crosspiece and said second crosspiece each has a single ply of material.

14. The brassiere according to claim 9, wherein said first crosspiece and said second crosspiece are made from a mesh fabric.

15. The brassiere according to claim 9, wherein said mesh fabric is approximately 83% nylon and approximately 17% spandex.

16. The brassiere according to claim 9, wherein said first crosspiece and said second crosspiece are made from a fabric having approximately 83% nylon and approximately 17% spandex.

17. The brassiere according to claim 9, wherein said insert is fabricated from a semi-rigid plastic.

18. The brassiere according to claim 9, wherein said channel is a vertical channel.

19. A brassiere comprising:

a body having a first breast cup with a lower edge and a second breast cup with a lower edge, and a center therebetween;

the lower edges of the first breast cup and the second breast cup each curving upwardly toward the center of the brassiere;

a first elastic crosspiece adjacent the lower edge of said first breast cup and a second elastic crosspiece adjacent the lower edge of said second breast cup, the first and second elastic crosspieces formed of a powernet material and terminating at the center of the brassiere to form a lower peripheral edge of the brassiere, the lower peripheral edge beneath the center of the brassiere having an approximate inverted V-shape; and the first crosspiece and the second crosspiece overlapping and connecting to form a central gore between said first and second breast cups.

* * * * *